US006061224A

United States Patent [19]

Allen

[11] Patent Number: 6,061,224

[45] Date of Patent: May 9, 2000

[54] PWM SOLENOID DRIVER AND METHOD

[75] Inventor: Dwight D. Allen, Tucson, Ariz.

[73] Assignee: Burr-Brown Corporation, Tucson, Ariz.

[21] Appl. No.: 09/191,079

[22] Filed: Nov. 12, 1998

[51] Int. Cl.[7] ..... H01H 47/00

[52] U.S. Cl. ..... 361/154; 361/152; 361/115; 361/194

[58] Field of Search ..... 361/152, 153, 361/154, 115, 194, 203, 187

[56] References Cited

U.S. PATENT DOCUMENTS

| | | | |
|---|---|---|---|
| 3,579,052 | 5/1971 | Kato et al. | 317/148.5 |
| 3,864,608 | 2/1975 | Normile et al. | 317/148.5 |
| 4,227,230 | 10/1980 | Bray | 361/152 |
| 4,293,888 | 10/1981 | McCarty | 361/152 |
| 4,310,868 | 1/1982 | Lillie et al. | 361/154 |
| 4,546,403 | 10/1985 | Nielsen | 361/154 |
| 4,599,548 | 7/1986 | Schultz | 318/599 |
| 4,630,165 | 12/1986 | D'Onofrio | 361/154 |
| 4,680,667 | 7/1987 | Petrie | 361/154 |
| 4,720,762 | 1/1988 | Estes | 361/154 |
| 4,729,056 | 3/1988 | Edwards et al. | 361/153 |
| 4,764,840 | 8/1988 | Petrie et al. | 361/154 |
| 4,812,945 | 3/1989 | D'Onofrio | 361/154 |
| 4,890,188 | 12/1989 | Russell et al. | 361/154 |
| 5,414,342 | 5/1995 | Mammano et al. | 323/288 |
| 5,450,276 | 9/1995 | Olifant et al. | 361/152 |
| 5,469,095 | 11/1995 | Peppiette et al. | 327/110 |
| 5,629,610 | 5/1997 | Pedrazzini et al. | 323/283 |

OTHER PUBLICATIONS

"Solenoid Driver Circuit Arrangement" by H. W. Johnson, IBM Technical Disclosure Bulletin, vol. 23, No. 7B, Dec. 1980, pp. 3359–3360.

L294 Switch–Mode Solenoid Driver, SGS–Thomson Microelectronics, Oct. 1991, pp. 1–8.

iC–JE PWM Relay/Solenoid Driver, iC–Haus GmbH Integrated Circuits, Rev Bo, pp. 1–10. Jan. 1998.

*Primary Examiner*—Stephen W. Jackson

*Attorney, Agent, or Firm*—Cahill, Sutton & Thomas P.L.C.

[57] ABSTRACT

A solenoid driver circuit includes an input terminal for receiving a solenoid actuation pulse, an output terminal for connection to a terminal of a solenoid coil, a pull-in current adjustment terminal, and a hold-in current duty cycle adjustment terminal. A pull-in current duration circuit includes a first input coupled to the input terminal, an output producing a pull-in current duration pulse, and a second input coupled to the pull-in current adjustment terminal. A hold-in current duty cycle control circuit includes a first input coupled to receive a triangular waveform signal, a second input coupled to the hold-in current duty cycle adjustment terminal, and a third input coupled to the output of the pull-in current duration circuit. An output transistor includes a control electrode coupled to an output terminal of the hold-in current duty cycle control circuit, and a current carrying terminal coupled to the output terminal. The hold-in current duty cycle control circuit applies a drive pulse to the control electrode of the output transistor for the duration of the pull-in current duration pulse, followed by a sequence of PWM hold-in current pulses respectively turning the output transistor on and off until the end of the solenoid actuation pulse.

10 Claims, 4 Drawing Sheets

PWM SOLENOID DRIVER AND METHOD

BACKGROUND OF THE INVENTION

The invention relates to solenoid driver circuits that establish an initial actuation or pull-in current duration and a duty cycle of subsequent hold-in current pulses in a coil of a solenoid.

By way of background, there are a number of known solenoid driver circuits that operate to build up a large turn-on drive current, referred to as a "pull-in current", in the coil of a solenoid for an initial time period to thereby ensure fast, reliable actuation of the solenoid. The known solenoid drivers then supply a chopped or PWM (pulse width modulated) current, referred to as a "hold-in current", to the solenoid coil to reduce the power dissipation as the solenoid driver circuit continues to maintain the solenoid in an "on" condition.

For example, U.S. Pat. No. 4,227,230 discloses a solenoid driver in which a ramped-up drive current to the solenoid coil occurs during an initial pull-in period that is determined by an RC circuit, to initially, rapidly actuate the solenoid/valve. After the solenoid/valve is initially turned "on", then a "chopping period" occurs during which a chopped current of predetermined duty cycle maintains the solenoid in its on condition with a greatly reduced average drive current through the solenoid coil. The duty cycle of the chopped hold-in current is determined by some of the same RC circuit components that establish the duration of the ramp up or pick current.

Many prior solenoid drivers which are implemented as integrated circuits sense the current through the solenoid coil and use a closed loop feedback circuit to control the coil current by using the feedback to adjust pull-in current duration or hold-in current duty cycle. The circuitry of such solenoid drivers is undesirably complex.

It should be appreciated that solenoids and solenoid driver circuits are used in a wide range of applications and environments which impose a wide range of constraints on the speed and power dissipation of solenoid driver circuits. For example, various applications provide various power supply voltages that must be used for the solenoids and solenoid driver circuits. A typical prior art solenoid driver circuit includes complex circuitry for adjusting the pull-in current or the hold-in current, and changing one usually affects the other, so multiple circuit component changes usually are required.

Partly because of this wide range of environment and applications in which solenoid drivers are used, it is very desirable that the ramp-up duration for the pull-in current in a solenoid coil be constant and independent of the duty cycle and/or frequency of the PWM hold-in current. It also is very desirable that the pull-in current and the hold-in current produced by a solenoid driver circuit each be easily set independently of the other. These desirable features are not provided by the prior driver circuits known to the applicant. Furthermore, the number of external components required in the closest prior art solenoid driver circuits is larger than desirable.

Those skilled in the art will appreciate that in an integrated circuit the resistances of resistors and the capacitances of capacitors often vary by about ±20% from nominal values, and that it would not be acceptable for the hold-in current duty cycle of a solenoid driver circuit to be subjected to a unit-to-unit variation of anywhere near ±20%. This probably is why the circuitry that determines the hold-in current duty cycle in prior solenoid drivers has not been designed to be settable merely by selecting the value of a single component.

SUMMARY OF THE INVENTION

Accordingly, it is an object of the invention to reduce power dissipation in solenoid driver circuits.

It is another object of the invention to provide a solenoid driver circuit in which the pull-in current duration is adjustable independently of the hold-in current.

It is another object of the invention to provide an integrated circuit solenoid driver circuit in which the pull-in current duration can be adjusted by adjusting a single circuit component without affecting the hold-in current.

It is another object of the invention to provide an integrated circuit solenoid driver circuit in which the hold-in current duty cycle can be adjusted by changing a single component or a single voltage without affecting the pull-in current duration.

It is another object of the invention to provide an integrated circuit solenoid driver circuit in which the accuracy of the hold-in circuit duty cycle is substantially greater than the usual ±20 percent accuracy with which ordinary integrated circuit resistors and capacitors are manufactured.

It is another object of the invention to provide an integrated circuit solenoid driver of the type described wherein the pull-in current and hold-in current are independent of power supply variations.

Briefly described, and in accordance with one embodiment thereof, the invention provides an integrated circuit solenoid driver circuit (10) including an input terminal (30) for receiving a solenoid actuation pulse (20), an output terminal (31) for connection to a terminal of a solenoid coil (11), a ground terminal (33), a pull-in current duration adjustment terminal (34), and a hold-in current duty cycle adjustment terminal (35). A pull-in current duration circuit (15) includes a first input coupled to the input terminal (30), an output (36) producing a pull-in current duration pulse, and a second input coupled to the pull-in current adjustment terminal (34). An oscillator (14) produces a triangular waveform signal. A hold-in current duty cycle control circuit (13) includes a first input (37) coupled to receive the triangular waveform signal, a second input coupled to the hold-in current duty cycle adjustment terminal (35), and a third input (36) coupled to the output of the pull-in current duration circuit (15). The hold-in current duty cycle adjustment circuit logically ORs the pull-in current duration control pulse (36) with the PWM signal (37A) to produce a switch drive signal on the output conductor (38). An output transistor (12) includes a control electrode coupled to the output terminal (38) of the hold-in current duty cycle control circuit (13), and a current-carrying terminal coupled to the output terminal (31). The hold-in current duty cycle control circuit (13) produces a drive signal (38) to the control electrode of the output transistor for the duration of the solenoid actuation pulse (20). The drive signal is the logical OR of the pull-in current duration pulse (36) and the hold-in current control pulses, logically ANDed with the solenoid actuation pulse (20).

In the described embodiment, the pull-in current duration circuit includes a first comparator (53) having a first input coupled to receive a reference voltage ($V_{REF}$) and a second terminal coupled to the pull-in current duration adjustment terminal (34). A first constant current source (52) and a pull-in current duration adjustment capacitor (16) are coupled to the pull-in current duration adjustment terminal, the first comparator producing the pull-in current duration control pulse (36) from a first time at which charging of the pull-in current duration adjustment capacitor (16) by the first constant current source begins until a second time at which the first current source has charged the pull-in current duration adjustment capacitor to a voltage equal to the reference voltage. The pull-in current duration circuit (15) includes a reset circuit (57) coupled to reset the pull-in current duration adjustment capacitor (16) when no solenoid actuation pulse is present and to release the pull-in current duration adjustment capacitor at the beginning of the solenoid actuation pulse. The hold-in current duty cycle control circuit (13) includes a second comparator (55) having a first input coupled to receive the triangular waveform and a second input coupled to the duty cycle control terminal (35) to produce the PWM signal on the output of the second comparator. The hold-in current duty cycle control circuit includes an ORing circuit (42) coupled to logically OR the pull-in current duration control pulse with the PWM signal to produce a pull-in and hold-in control signal (43), and an ANDing circuit (44) coupled to logically AND the pull-in and hold-in control signal with the solenoid actuation pulse to produce the switch drive signal.

DETAILED DESCRIPTION OF THE PREFERRED EMBODIMENTS

Figure 1:
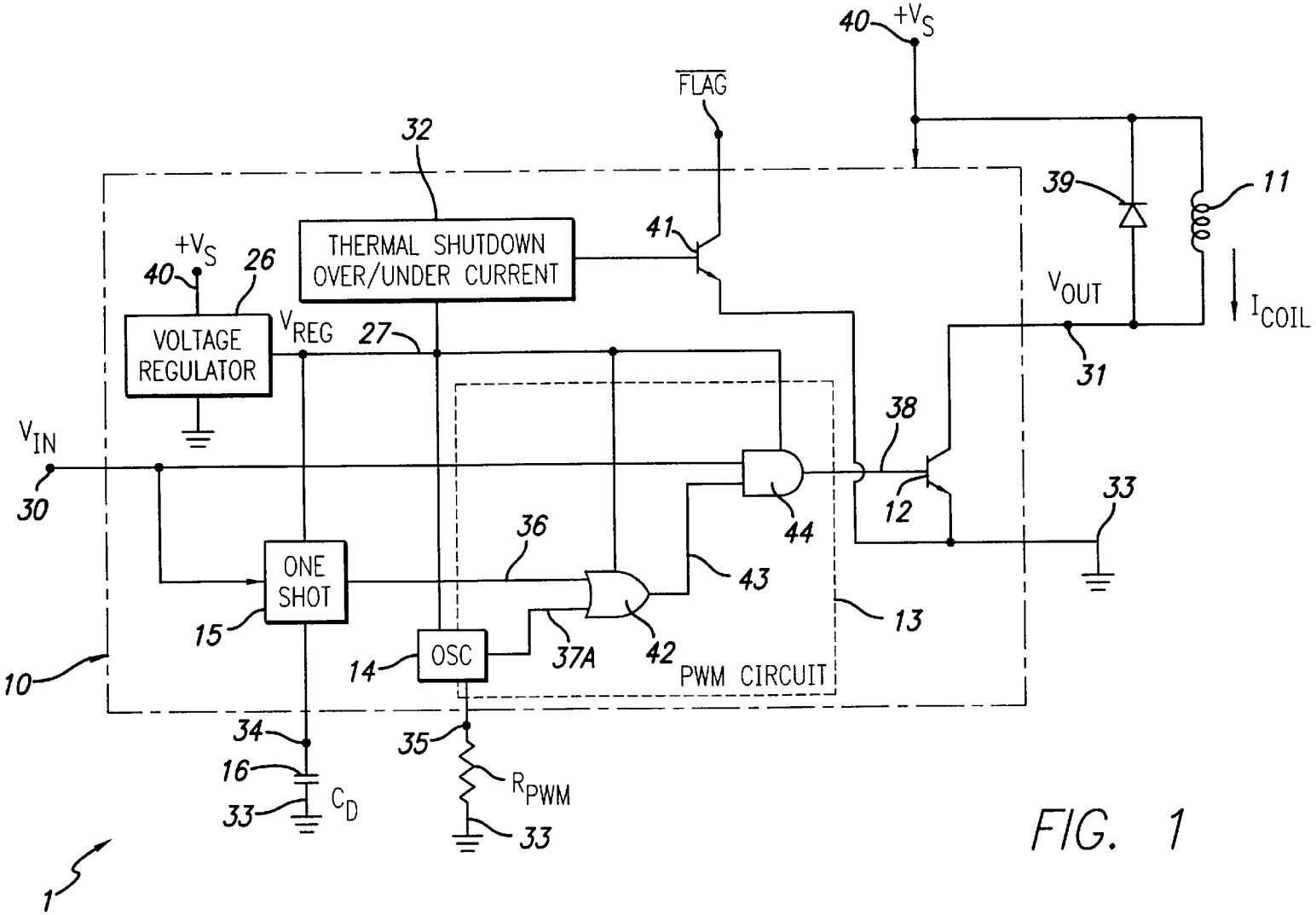
FIG. 1 is a schematic diagram of the present invention.

FIG. 1 shows a block diagram of the PWM solenoid driver 10 of the present invention, connected to an external delay adjustment capacitor 16 and to an external duty cycle adjustment resistor 17, and also connected to drive an external solenoid coil 11. Solenoid driver 10 is encapsulated in an integrated circuit package having an input lead 30 on which a solenoid control signal $V_{IN}$ is applied, a pull-in current duration adjustment lead 34 to which a delay adjustment capacitor 16 is connected, a duty cycle adjustment lead 35 to which duty cycle adjustment resistor 17 is connected, a ground lead 33, a power supply lead 40 to which a positive supply voltage $+V_S$ is applied, and an output lead 31 on which $V_{OUT}$ is produced. Solenoid coil 11 is connected between leads 31 and 40, either in the order shown in FIG. 1 or in the reverse order subsequently described with reference to FIG. 1A. Capacitor 16 and resistor 17 are connected between ground 33 and leads 34 and 35, respectively. An internal voltage regulator 26 is connected between $+V_S$ and ground to produce a constant, regulated supply voltage $V_{REG}$ on conductor 27. A freewheeling diode 39 has its anode connected to conductor 31 and its cathode connected to $+V_S$ conductor 40.

Figure 2:
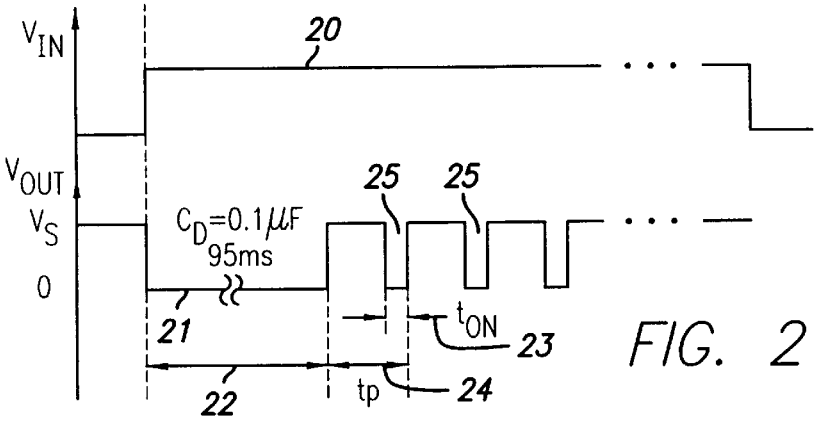
FIG. 2 is a timing diagram for the solenoid driver circuit of FIG. 1.
Figure 3:
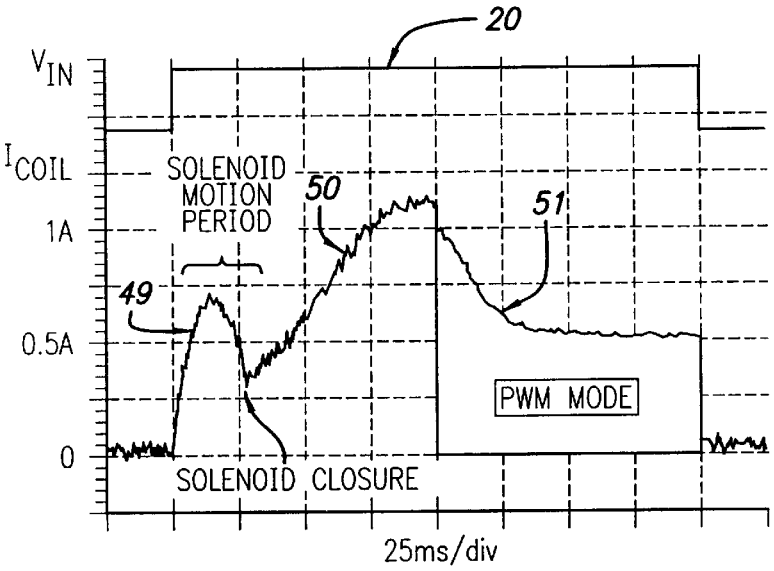
FIG. 3 is a graph of a typical solenoid coil current.

Input lead 30 of solenoid driver circuit 10 is connected to an input of a one-shot circuit 15 and to an input of a PWM circuit 13. PWM circuit 13 is coupled as indicated by numeral 37A to receive PWM pulses produced by a free running 24 kilohertz oscillator 14. PWM circuit 13 as shown in simplified form in FIG. 1 includes an OR circuit 42 that logically ORs (1) a pull-in current duration control pulse produced on conductor 36 by a one-shot circuit 15 in response to a leading edge of a solenoid actuation pulse on $V_{IN}$ terminal 30 with the PWM pulses produced on conductor 37A in response to free-running oscillator 14 in order to produce a control signal that includes either a pull-in current duration control pulse or a PWM control signal on conductor 43. This is subsequently explained in more detail with reference to FIG. 4. PWM circuit 13 also includes an AND circuit 44 that logically ANDs the signal on conductor 43 with the solenoid actuation pulse on conductor 30 to produce a switch drive signal on conductor 38. The switch drive signal on conductor 38 is applied to the base of an NPN transistor 12, the emitter of which is connected to ground conductor 33. The collector of NPN transistor 12 is connected to output conductor 31. The solenoid actuation pulse is designated by numeral 20, and both it and the coil drive voltage signal $V_S-V_{OUT}$ developed across solenoid coil 11 in response to the collector current of transistor 12 both are shown in FIG. 2. The waveforms of solenoid actuation pulse 20 and a corresponding current $I_{COIL}$ through solenoid coil 11 are shown in FIG. 3.

The above-mentioned switch drive signal produced on conductor 38 by PWM circuit 13 includes (1) a pull-in current control pulse for the duration of a pull-in current duration pulse produced on conductor 36 by one-shot circuit 15, followed immediately by (2) a PWM control signal which continues until the end of the solenoid actuation pulse 20 (FIG. 2). As subsequently explained, the duty cycle of the PWM control signal is determined by the voltage on conductor 35, which can be set by any suitable voltage source, such as duty cycle adjust resistor 17 having a precise resistance $R_{PWM}$ (as shown) or by a digital-to-analog converter (not shown). The length of the pull-in current duration control pulse produced on conductor 36 by one-shot circuit 15 is determined by the value CD of capacitor 16.

Although not essential to the present invention, a thermal shutdown and over/under-current-indicating circuit 32 can be provided to turn on a transistor 41 and produce a "flag" signal in the event of excessive chip temperature, the occurrence of an excessive overcurrent through transistor 12, or the occurrence of an inadequate current through transistor 12.

Figure 4:
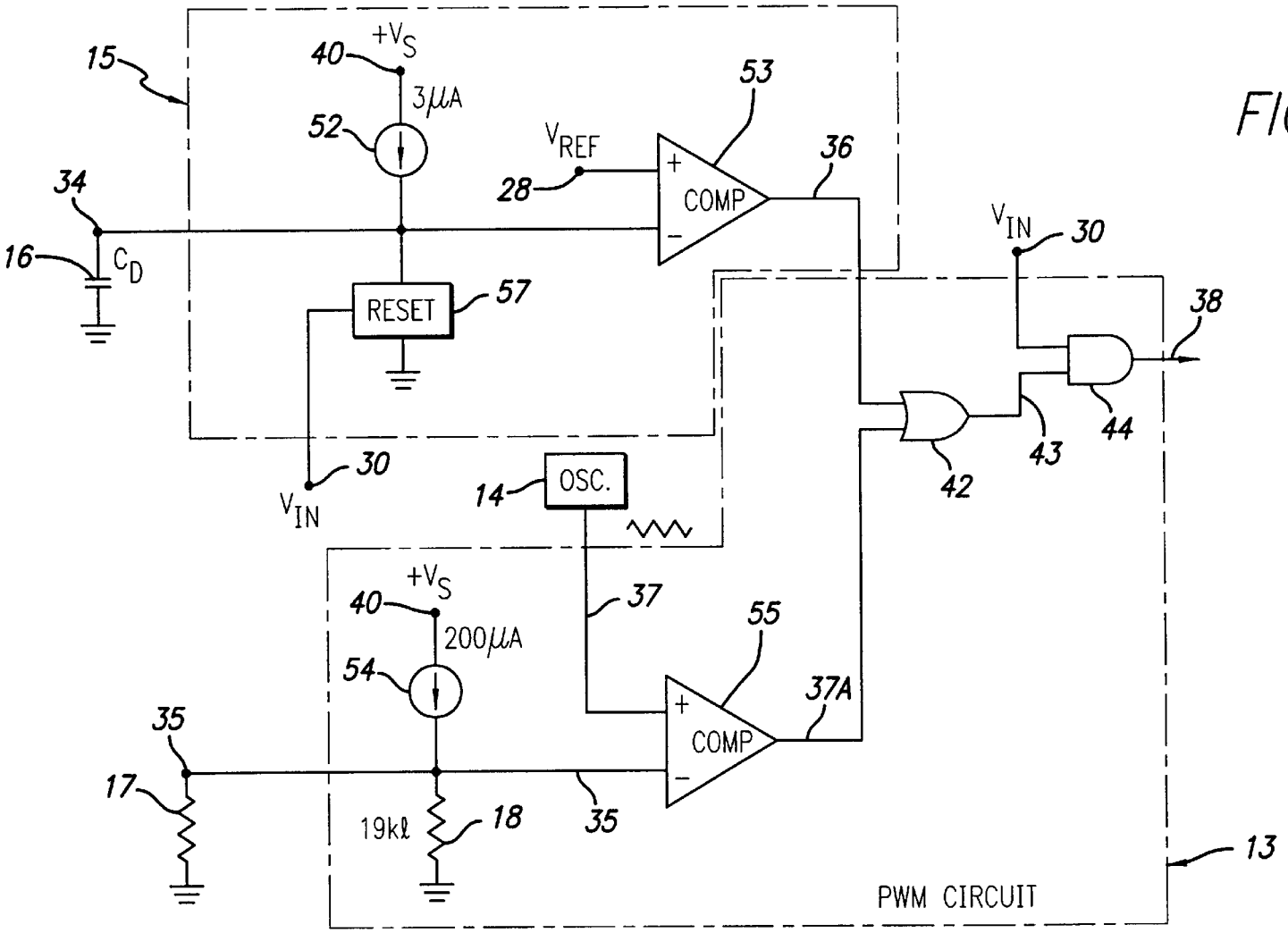
FIG. 4 is a simplified schematic diagram of the delay adjustment circuit 15 and a portion of the PWM circuit 13 in FIG. 1.

FIG. 4 shows a simplified schematic diagram of a portion of the one-shot circuit 15 that produces the pull-in current duration control pulse on conductor 36 and a portion of PWM circuit 13. A reference voltage $V_{REF}$ is applied by conductor 28 to the (+) input of a comparator 53. The (−) input of comparator 53 is connected by conductor 34 to the junction between a precisely trimmable 3 microampere constant current source 52 and pull-in current duration adjustment capacitor 16. Capacitor 16 is reset to ground and held at ground by a reset circuit 57 in the absence of a $V_{IN}$ pulse 20 (FIG. 3) on conductor 30. That causes comparator 53 to produce the pull-in current duration control pulse on conductor 36 that is at a high level until the time at which current source 52 has charged capacitor 16 up to the value of $V_{REF}$ and then switches to a low level.

The triangular waveform produced on conductor 37 by oscillator 14 is applied to the (+) input of a comparator 55. The (−) input of comparator 55 is connected by conductor 35 to the junction between a 200 microampere constant current source 54 and the parallel combination of duty cycle adjustment resistor 17 (FIG. 1) and an internal 19 kilohm resistor 18. During the times when the triangular oscillator output waveform on conductor 37 in FIG. 4 is greater than the duty cycle adjustment voltage on conductor 35, comparator 55 produces a positive level on conductor 37A. The duty cycle adjustment voltage on conductor 35 therefore establishes the duty cycle of a sequence of PWM pulses on conductor 37A.

Solenoid actuation pulse 20 (FIG. 2) is applied to $V_{IN}$ lead 30 to initiate and maintain actuation of the solenoid being driven by solenoid driver circuit 10. To this end, solenoid actuation pulse 20 is applied as an input to one-shot circuit 15 by applying it to reset circuit 57, which clamps pull-in current duration control conductor 34 to ground when solenoid actuation pulse 20 is absent and releases conductor 34 from ground when solenoid actuation pulse 20 is present. Solenoid actuation pulse 20 also is applied to PWM circuit 13 by logically ANDing it with the PWM control signal on conductor 43. The PWM control signal on conductor 43 is produced by logically ORing the pull-in current duration control pulse produced by one-shot circuit 15 on conductor 36 with the PWM pulses produced by comparator 55 on conductor 37A.

At the end of any solenoid actuation pulse 20 (FIG. 2), capacitor 16 is discharged to and held at zero volts by one-shot circuit 15. The initial portion of the next solenoid actuation pulse 20 unclamps conductor 34 from ground and immediately allows the 3 microampere current source 52 to charge capacitor 16. When the resulting ramp voltage on conductor 34 exceeds $V_{REF}$ (which typically is equal to 3 volts), that marks the beginning of the PWM hold-in current operation of solenoid driver circuit 10. The level of the duty cycle adjustment voltage on conductor 35, which is established by 19 kilohm resistor 18 in parallel with external duty cycle adjustment resistor 17, determines precisely when the oscillator triangular output waveform on conductor 37 turns comparator 55 on and off, causing the PWM pulse transitions on conductor 37A. The voltage of the PWM signal on conductor 37A is high for the portion of each cycle of the triangular oscillator output waveform on conductor 37 during which the triangular waveform voltage exceeds the duty cycle control voltage on conductor 35. From the time at which the ramp voltage on conductor 34 exceeds $V_{REF}$until the end of solenoid actuation pulse 20, the signal on conductor 43 is equal to the PWM signal on conductor 37A. Therefore, the voltage on conductor 38 also is equal to the PWM signal on conductor 43, until the end of $V_{IN}$ pulse 20.

Thus, the switch drive signal on conductor 38 includes an initial pull-in control pulse for the duration of the one-shot output pulse on conductor 36 immediately followed by a reference of PWM holding current pulses until the end of the $V_{IN}$ actuation pulse 20.

The fundamental frequency of the PWM pulses on conductor 37A, after the initial delay indicated by arrow 24 in FIG. 2, is constant at 24 kilohertz. This frequency is high enough to prevent audible vibrations of the solenoid while it is in its hold-in mode of operation.

When the voltage on conductor 38 is high, it turns transistor 12 on, connecting solenoid coil 11 between $+V_S$ and ground, producing the solenoid coil current $I_{COIL}$ shown in FIG. 3. Numerals 49 and 50 in FIG. 3 show the waveform of the pull-in portion of the solenoid coil current $I_{COIL}$ for the duration of the pull-in control pulse. This produces the zero voltage level of $V_{OUT}$ on conductor 31 as indicated by numeral 21 in FIG. 2.

The freewheeling diode 39 (FIG. 1) serves to maintain a fairly constant current flow in solenoid coil 11 during the portions of the PWM mode that transistor 12 is off. This results in the portion 51 of the coil current curve shown in FIG. 3, and causes a fairly constant hold-in force in the solenoid and provides low generation of electromagnetic interference.

The delay time indicated by the width 22 of $V_{OUT}$ pulse 21 is approximately $C_D \times 10^6$, where the time is in seconds and $C_D$ is in farads.

Figure 6:
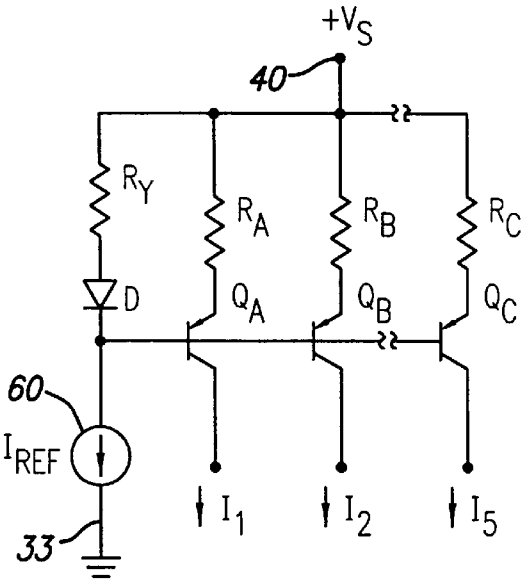
FIG. 6 is a schematic diagram of a generalized laser trimmable current source circuit that can be used to provide the precisely trimmed current sources I1–I5 in FIG. 5.
Figure 5:
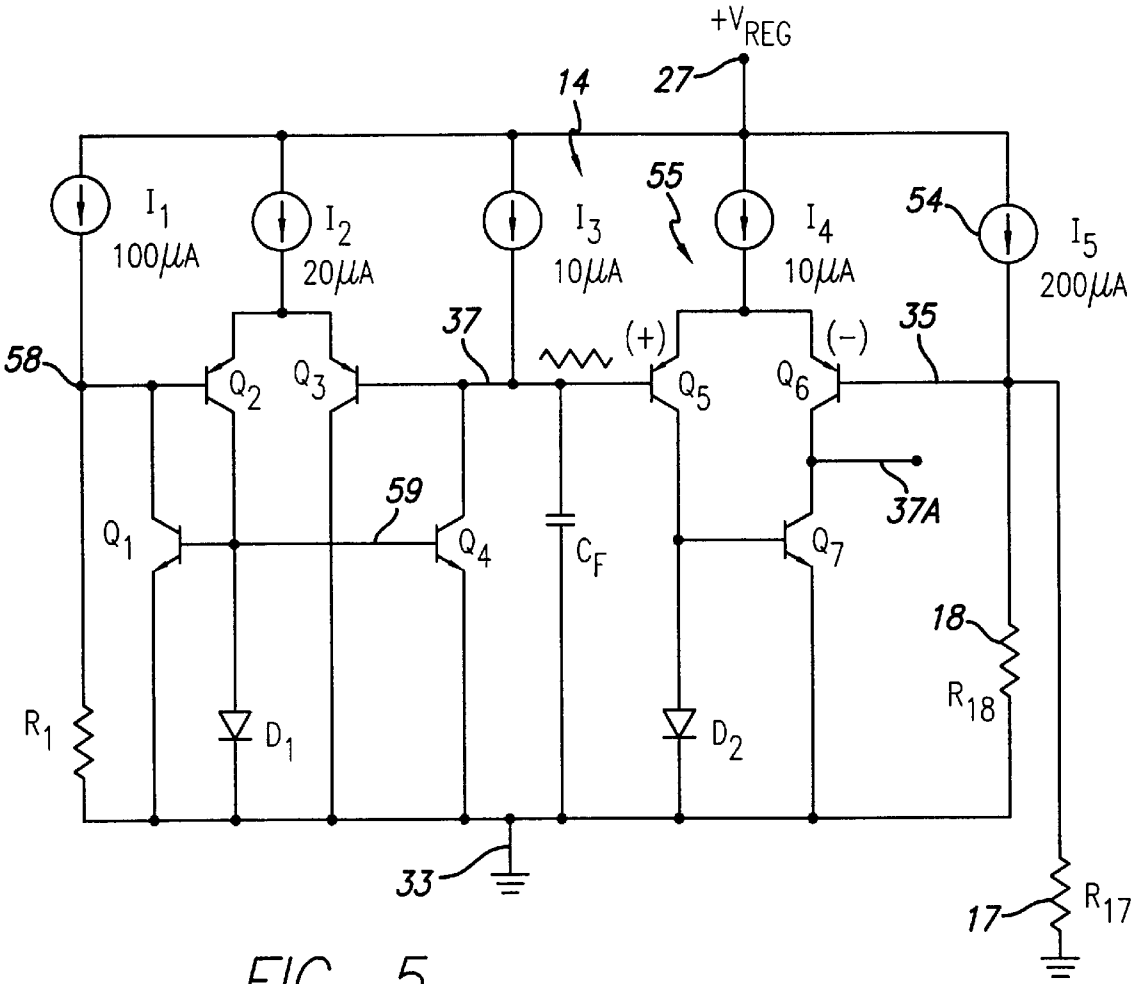
FIG. 5 is a schematic diagram of circuitry in the PWM circuit of FIG. 4 that provides a hold-in current duty cycle that is relatively independent of the usual ±20% unit-to-unit component value variations in typical integrated circuits.

As indicated previously, the individual component values of integrated circuits have a chip-to-chip variation of about ±20 percent. Therefore, use of a single external circuit component to set the hold-in current duty cycle or the pull-in current duration of an integrated circuit solenoid driver is impractical unless the chip-to-chip variations in the currents of constant current sources 52 and 54 and the resistance of resistor 18 in FIG. 4 are lower than about ±5 percent despite the typical ±20 percent chip-to-chip variation circuit component values. FIGS. 5 and 6 show integrated circuitry which can be used to implant the circuits shown in FIG. 4 to accomplish this result. The precise ±5% ratio matching of resistor 18 in FIG. 4 and resistor R1 in FIG. 5 also is achieved by laser trimming.

Referring to FIG. 5, the portion of PWM circuit 13 including oscillator 14 and comparator 55 is shown. Oscillator 14 includes a 100 microampere current source $I_1$ which flows into a conductor 58 connected to the upper terminal of a trimmable resistor R1, the collector of NPN transistor Q1, and the base of a PNP transistor Q2. The lower terminal of resistor R1 and the emitter of transistor Q1 are connected to ground conductor 33. PNP transistors Q2 and Q3 have their emitters connected to a 20 microampere constant current source $I_2$. The collector of transistor Q2 is connected by conductor 59 to the base of transistor Q1, the anode of a diode $D_1$, and the base of an NPN transistor Q4. The cathode of diode $D_1$, the collector of transistor Q3, and the emitter of transistor Q4 all are connected to ground conductor 33. The collector of transistor Q4 is connected to the base of transistor Q3 by conductor 37, on which the triangular output waveform of oscillator 14 is produced. A 10 microampere constant current source $I_3$ is connected to conductor 37. A frequency determining capacitor $C_f$ is connected between conductor 37 and ground conductor 33.

Conductor 37 is connected to the base of PNP transistor Q5, which together with PNP transistor Q6 form the input pair of comparator 55. A 10 microampere current source I4 is connected to the emitters of transistors Q5 and Q6. The collector of transistor Q5 is connected to the anode of a diode D2 and the base of an NPN transistor Q7. The cathode of diode D2 and the emitter of transistor Q7 are connected to ground conductor 33. The collector of transistor Q7 is connected by conductor 37A to the collector of transistor Q6. The base of transistor Q6 forms the (−) input of comparator 55, and is connected to conductor 35. Conductor 35 is connected to constant current source 54, and internal resistor 18, and external duty cycle adjustment resistor 17, just as also shown in FIG. 4. The duty cycle control voltage on conductor 35 is set by the flow of the current I5 of constant current source 54 through the equivalent resistance of the parallel combination of resistors 17 and 18. Comparator 55 then can compare the triangle waveform on conductor 37 with the duty cycle control voltage on conductor 35 to set the duty cycle of the signal on conductor 37A.

Each of the constant current sources I1–I5 shown in FIG. 5, wherein current source I5 is the current source 54 shown in FIG. 4, are laser trimmable during manufacture of the integrated circuit to values which are much more precise than the usual ±20%. To achieve this accuracy by laser trimming, these current sources are implemented generally as shown in FIG. 6, in which multiple current sources producing constant currents $I_1$, $I_2$, . . . $I_5$ all are trimmed during manufacture by trimming a single reference current source 60 that produces $I_{REF}$. The bases of PNP transistors $Q_A$, $Q_B$ . . . $Q_C$ are connected to the junction between trimmable current source 60 and the cathode of diode D. The anode of diode D and the emitters of $Q_A$, $Q_B$ . . . $Q_C$ are coupled to $+V_S$ by resistors $R_y$, $R_A$, $R_B$ . . . $R_Z$, respectively. The magnitudes of various currents $I_1$, $I_2$, etc. in the collectors of PNP transistors $Q_A$, $Q_B$, etc., respectively, are established by suitably ratioing the emitter areas of PNP transistors $Q_A$, $Q_B$, etc. relative to the emitter area of a diode-connected transistor D, and also by scaling the emitter resistors $R_A$, $R_B$, $R_C$, etc. to resistor $R_Y$. Laser trimmable current source 60 is of conventional design, and includes a band gap circuit to establish a constant voltage across a laser trimmable resistor to produce the trimmable reference current $I_{REF}$.

Thus, the circuit of FIG. 6 allows precise trimming of one current source 60 to obtain a desired absolute value of $I_{REF}$ and $I_1$, $I_2$ . . . $I_5$. That trimming operation automatically accomplishes trimming of $I_1$, $I_2$ . . . $I_5$ current sources precisely (within ±5%) to their desired absolute values. Consequently, current sources 54 and 52 in FIG. 4 can be provided with very little chip-to-chip variation, so the pull-in current duration and the hold-in current duty cycle can be precisely established each by using a corresponding separate single external component.

Referring again to FIG. 5, Oscillator 14 operates by toggling the current I2 between transistors Q2 and Q3. When I2 passes through transistor Q2 and diode D1, a matching 20 microampere current passes through transistor Q4. The 10 microampere difference between this 20 microampere current and the 10 microampere current I3 is supplied by the frequency determining capacitor $C_f$. This causes the voltage at the base of transistor Q3 to ramp lower until transistor Q3 turns on, switching I2 through transistor Q3. Transistor Q4 then is turned off, and the voltage on conductor 37 then ramps up until Q3 is turned off, thereby turning transistor Q2 back on. As transistor Q4 is repetitively turned on, transistor Q1 also is repetitively turned on and diverts a portion of I1 through resistor R1. This produces a square wave at the base of transistor Q2 that sets the upper and lower magnitudes of the triangle waveform produced on conductor 37. Thus, the duty cycle is precisely established by the voltage established on conductor 35 by the single external resistor 18.

In FIG. 6, the current through the diode D is trimmed by trimming current source 60 to a value which produces the desired current, for example I5=200 microamperes, through transistor $Q_C$.

The above-described solenoid driver circuit avoids any interdependence between the duration of the pull-in current and the duty cycle of the hold-in current, and provides a very stable pull-in current duration that is adjustable by a single first component, and a very stable PWM hold-in current duty cycle that is adjustable by a different single component or a voltage, and thereby avoids the above mentioned shortcomings of the prior art. The internal voltage regulator circuit 26 provides a constant internal regulated supply voltage $V_{REG}$ to supply internal circuitry of solenoid driver circuit 10. Consequently, the pull-in current duration and the duty cycle of the hold-in current are independent of the external power supply voltage $+V_S$.

The above described driver circuit also can be used effectively as a driver for any loads in which a precisely controlled turn-on current is needed, for example as a lamp driver, a DC motor driver, a heater driver, or a thermoelectric heat pump driver. The initial resistance of a resistive lamp is very low while it is cold. The capacitance $C_D$ can be set to a very low value or eliminated entirely to produce a very short duration initial turn-on current in a lamp element, after which the "maintenance" current through the lamp element can be controlled by adjustment of the duty cycle control voltage on conductor 35. Good control of the short duration turn-on current and the duty cycle of the "maintain" current can increase the lamp life. Similarly, the capacitance $C_D$ can be set to a suitable value or eliminated entirely to produce a suitable duration of the initial turn-on current in a DC motor, heater, or thermoelectric heat pump. In the case of DC motor, the initial turn-on current duration can be set to overcome initial inertia, to get the motor quickly up to speed. In the case of a heater or thermoelectric heat pump, the initial turn-on current duration can be set to overcome thermal inertia or lag, to accomplish rapid temperature change.

Figure 1A:
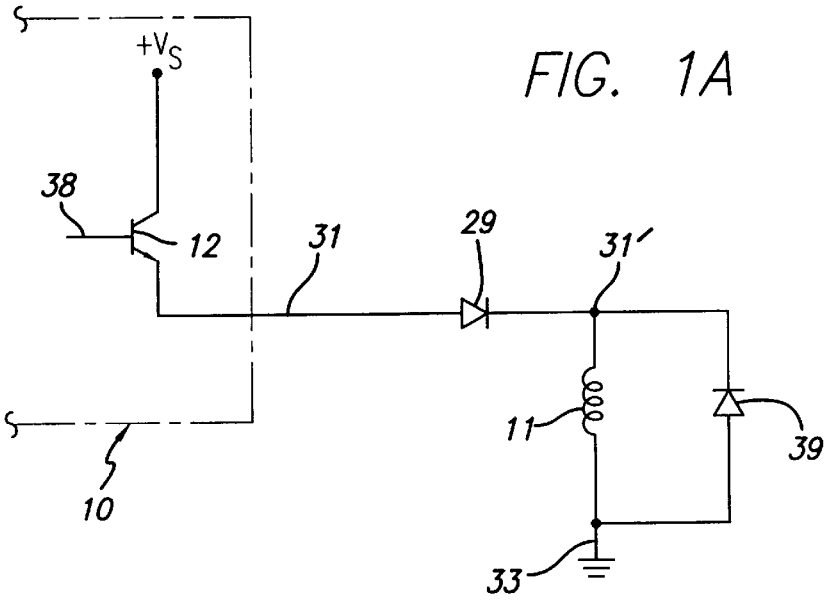
FIG. 1A is a schematic diagram of an alternate arrangement for connecting the output transistor 12 to an external solenoid coil.

While the invention has been described with reference to several particular embodiments thereof, those skilled in the art will be able to make the various modifications to the described embodiments of the invention without departing from the true spirit and scope of the invention. It is intended that all elements or steps which are insubstantially different or perform substantially the same function in substantially the same way to achieve the same result as what is claimed are within the scope of the invention. For example, the positions of transistor 12 and coil 11 in FIG. 1 can be reversed as shown in FIG. 1A so that transistor 12 is connected between $+V_S$ and conductor 31, and solenoid coil 11 and freewheeling diode 39 are coupled between conductor 31 and ground by a diode 29. In this case, the emitter of transistor 12 is connected by output conductor 31 to the anode of diode 29, and the cathode of diode 29 is connected to the upper terminals of solenoid coil 11 and freewheeling diode 39, the lower terminals of which are connected to ground. Diode 29 allows the voltage on conductor 38 to control conduction by transistor 12 when the current through freewheeling diode 39 produces a negative voltage on conductor 31'.

What is claimed is:

1. A solenoid driver circuit comprising:

(a) an input terminal for receiving a solenoid actuation pulse, an output terminal for connection to a terminal of a solenoid coil, a ground terminal, a pull-in current duration adjustment terminal, and a hold-in current duty cycle adjustment terminal;

(b) a pull-in current duration circuit having a first input coupled to the input terminal and a second input coupled to the pull-in current adjustment terminal and producing a pull-in current duration control pulse in response to the solenoid actuation pulse, the duration of the pull-in current duration control pulse being determined by a signal level on the pull-in current adjustment terminal;

(c) an oscillator producing a triangular waveform signal;

(d) a hold-in current duty cycle control circuit having a first input coupled to receive the triangular waveform signal and a second input coupled to the hold-in current duty cycle adjustment terminal to produce a PWM signal, and the hold-in current duty cycle control circuit including a third input coupled to the pull-in current duration adjustment terminal and logically ORing the pull-in current duration control pulse with the PWM signal to produce a switch drive signal on an output conductor;

(e) an output transistor having a control electrode coupled to the output conductor of the hold-in current duty cycle control circuit, and a current-carrying terminal coupled to the output terminal of the solenoid driver circuit; and (f) the hold-in current duty cycle control circuit applying the switch drive signal to the control electrode, the switch drive signal including a pull-in current pulse turning on the output transistor for the duration of the pull-in current duration control pulse to cause a pull-in current of like duration to be established in the solenoid coil followed by a sequence of PWM hold-in current pulses repetitively turning the output transistor on and off until the end of the solenoid actuation pulse.

2. The solenoid driver circuit of claim 1 wherein a solenoid coil is coupled between the output terminal and a supply voltage.

3. The solenoid driver circuit of claim 2 including a freewheeling diode 39 coupled in parallel with the solenoid coil.

4. The solenoid driver circuit of claim 1 wherein the pull-in current duration circuit includes a first comparator having a first input coupled to receive a reference voltage and a second terminal coupled to the pull-in current duration adjustment terminal, a first constant current source and a pull-in current duration adjustment capacitor being coupled to the pull-in current duration adjustment terminal, the first comparator producing the pull-in current duration control pulse from a first time at which charging of the pull-in current duration adjustment capacitor by the first constant current source begins until a second time at which the first current source has charged the pull-in current duration adjustment capacitor to a voltage equal to the reference voltage.

5. The solenoid driver circuit of claim 4 wherein the pull-in current duration circuit includes a reset circuit coupled to reset the pull-in current duration adjustment capacitor when no solenoid actuation pulse is present and to release the pull-in current duration adjustment capacitor at the beginning of the solenoid actuation pulse.

6. The solenoid driver circuit of claim 5 wherein the hold-in current duty cycle control circuit includes a second comparator having a first input coupled to receive the triangular waveform and a second input coupled to the duty cycle control terminal to produce the PWM signal on the output of the second comparator.

7. The solenoid driver circuit of claim 6 including an ORing circuit coupled to logically OR the pull-in current duration control pulse with the PWM signal to produce a pull-in and hold-in control signal, and an ANDing circuit coupled to logically AND the pull-in and hold-in control signal with the solenoid actuation pulse to produce the switch drive signal.

8. A driver circuit comprising:

(a) an input terminal for receiving an actuation pulse, an output terminal for connection to a terminal of a load element, a ground terminal, a turn-on current duration adjustment terminal, and a maintain current duty cycle adjustment terminal;

(b) a turn-on current duration circuit having a first input coupled to the input terminal and a second input coupled to the turn-on current adjustment terminal and producing a turn-on current duration control pulse in response to the actuation pulse, the duration of the turn-on current duration control pulse being determined by a signal level on the turn-on current adjustment terminal;

(c) an oscillator producing a triangular waveform signal;

(d) a maintain current duty cycle control circuit having a first input coupled to receive the triangular waveform signal and a second input coupled to the maintain current duty cycle adjustment terminal to produce a PWM signal, and the maintain current duty cycle control circuit including a third input coupled to the turn-on current duration adjustment terminal and logically ORing the turn-on current duration control pulse with the PWM signal to produce a switch drive signal on an output conductor;

(e) an output transistor having a control electrode coupled to the output conductor of the maintain current duty cycle control circuit, and a current-carrying terminal coupled to the output terminal of the driver circuit; and (f) the maintain current duty cycle control circuit applying the switch drive signal to the control electrode, the switch drive signal including a turn-on current pulse turning on the output transistor for the duration of the turn-on current duration control pulse to cause a turn-on current of like duration to be established in the load element followed by a sequence of PWM maintain current pulses repetitively turning the output transistor on and off with a duty cycle determined by a voltage on the maintain duty cycle adjustment terminal until the end of the actuation pulse.

9. A method for operating a solenoid driver circuit including an input terminal, an output terminal for connection to a terminal of a solenoid coil, a ground terminal, a pull-in current duration adjustment terminal, and a hold-in current duty cycle adjustment terminal, the method including:

(a) applying a solenoid actuation pulse to a pull-in current duration circuit having a first input coupled to the input terminal and a second input coupled to the pull-in current adjustment terminal;

(b) setting a desired duration of a pull-in current duration control pulse to be produced by the pull-in current duration circuit by controlling a signal on the pull-in current adjustment terminal;

(c) producing the pull-in current duration control pulse in response to the solenoid actuation pulse and the signal on the pull-in current adjustment terminal;

(d) producing a triangular waveform signal;

(e) applying the triangular waveform signal to a first input of a hold-in current duty cycle control circuit and setting a duty cycle adjustment voltage level on a second input coupled to the hold-in current duty cycle adjustment terminal and comparing the triangular waveform signal to the duty cycle adjustment voltage level to produce a PWM signal;

(f) logically ORing the pull-in current duration control pulse with the PWM signal to produce a switch drive signal, the switch drive signal including a pull-in current pulse followed by a sequence of PWM pulses lasting until the end of the solenoid actuation pulse; and (g) applying the switch drive signal to the control electrode of an output transistor having a current-carrying terminal coupled to the solenoid coil.

10. A driver circuit comprising:

(a) an input terminal for receiving an actuation pulse, an output terminal for connection to a terminal of a load element, a ground terminal, a turn-on current duration adjustment terminal, and a maintain current duty cycle adjustment terminal;

(b) means having a first input coupled to the input terminal and a second input coupled to the turn-on current adjustment terminal for producing a turn-on current duration control pulse in response to the actuation pulse and a signal level on the turn-on current adjustment terminal, the duration of the turn-on current duration control pulse being determined by the signal level on the turn-on current adjustment terminal;

(c) means for producing a triangular waveform signal;

(d) duty cycle control means having a first input coupled to receive the triangular waveform signal and a second input coupled to the maintain current duty cycle adjustment terminal for producing a PWM signal in response to the triangular waveform signal and a signal level on the maintain current duty cycle adjustment terminal and logically ORing the turn-on current duration control pulse with the PWM signal to produce a switch drive signal on an output conductor, the switch drive signal including a turn-on current pulse turning on an output transistor for the duration of the turn-on current duration control pulse to cause a turn-on current of like duration to be established in the load element followed by a sequence of PWM maintain current pulses repetitively turning the output transistor on and off with a duty cycle determined by a voltage on the maintain duty cycle adjustment terminal until the end of the actuation pulse; and (e) the output transistor having a control electrode coupled to the output conductor of the maintain current duty cycle control circuit, and a current-carrying terminal coupled to the output terminal of the driver circuit.

* * * * *